US010655862B2

(12) United States Patent
Luckhardt et al.

(10) Patent No.: US 10,655,862 B2
(45) Date of Patent: May 19, 2020

(54) HEATABLE CAVITY FOR A KITCHEN APPLIANCE HAVING A LOW EMISSIVITY COATING

(71) Applicant: ELECTROLUX APPLIANCES AKTIEBOLAG, Stockholm (SE)

(72) Inventors: Christoph Luckhardt, Rothenburg ob der Tauber (DE); Michael Keidel, Bad Neustadt (DE); Fabienne Reinhard-Herrscher, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 147 days.

(21) Appl. No.: 15/741,270

(22) PCT Filed: Jul. 15, 2016

(86) PCT No.: PCT/EP2016/066871
§ 371 (c)(1),
(2) Date: Dec. 31, 2017

(87) PCT Pub. No.: WO2017/021125
PCT Pub. Date: Feb. 9, 2017

(65) Prior Publication Data

US 2018/0195736 A1 Jul. 12, 2018

(30) Foreign Application Priority Data

Jul. 31, 2015 (EP) ..... 15179260

(51) Int. Cl.
*F24C 15/00* (2006.01)

(52) U.S. Cl.
CPC ..... *F24C 15/005* (2013.01)

(58) Field of Classification Search
CPC ..... F24C 15/005
USPC ..... 126/19 R
See application file for complete search history.

(56) References Cited

U.S. PATENT DOCUMENTS 2,388,723 A * 11/1945 Cobb ..... C23D 5/00 427/235
2,678,990 A * 5/1954 Quirk ..... F24C 15/00 219/406
3,627,560 A * 12/1971 Morgan ..... F24C 15/005 427/330

(Continued)

FOREIGN PATENT DOCUMENTS

DE 4126790 2/1993

OTHER PUBLICATIONS

International Search Report and Written Opinion for PCT/EP2016/066871 dated Sep. 16, 2016, 8 pages.

*Primary Examiner* — Avinash A Savani
(74) *Attorney, Agent, or Firm* — Pearne & Gordon LLP

(57) ABSTRACT

A heatable cavity (2) for a kitchen appliance (1), particularly for an oven, wherein the heatable cavity (2) comprises a plurality of cavity walls defining a cooking chamber (7) for cooking foodstuff, and a central opening for placing foodstuff into the cooking chamber (7), wherein the outer surface of at least one of the cavity walls comprises a coating (10) that comprises a material with a low emissivity, preferably wherein said material with a low emissivity has a lower emissivity than oxidized steel.

17 Claims, 3 Drawing Sheets

(56) References Cited

U.S. PATENT DOCUMENTS

| | | | | |
|---|---|---|---|---|
| 3,700,484 | A * | 10/1972 | Williamitis | C03C 8/00<br>427/376.5 |
| 4,164,643 | A | 8/1979 | Dewitt et al. | |
| 5,139,010 | A * | 8/1992 | Borgens, Jr. | F24S 20/30<br>126/682 |
| 6,024,084 | A | 2/2000 | Gerhardinger | |
| 9,072,400 | B2 * | 7/2015 | Benford, Jr. | A47J 36/025 |
| 2013/0098903 | A1 | 4/2013 | Di Giovanni | |
| 2015/0083109 | A1 | 3/2015 | Baek et al. | |

* cited by examiner

HEATABLE CAVITY FOR A KITCHEN APPLIANCE HAVING A LOW EMISSIVITY COATING

The present invention relates to a heatable cavity for a kitchen appliance, particularly an oven, a method of manufacturing a heatable cavity for such kitchen appliance and such kitchen appliance.

The emissivity factor for heat of the outside surface of an enameled oven heatable cavity formed of sheet metal is usually relatively high, due to the blackening from the oxidized steel at the outside surface of the cavity that occurs during firing of the enamel coating of the inside surface of the cavity. Accordingly, an oven cavity may emit a relatively high amount of heat radiation. Such high emissivity in the prior art may be of about 0.9. The heat radiation is only to a small part absorbed/reflected by the insulation that is usually arranged on the outside of the heatable cavity.

The document DE 41 26 790 A1 shows a household oven with an enameled cavity that comprises an enamel layer on its inner surface, wherein the enamel contains substances to reflect the infrared radiation. However, with the reflecting substances in the internal enamel layer DE 41 26 790 A1 only attempts to reflect heat into the cavity, whereas the prior art misses any proposal to reduce the outwards emissivity of a heated oven cavity might be reduced.

It is an object of the present invention to provide a heatable cavity, a method of manufacturing a heatabnle cavity and/or a household appliance comprising such heatable cavity with a reduced emissivity to the cavity outside.

A heatable cavity for a kitchen appliance, particularly an oven, comprises a plurality of cavity walls that preferably are formed of sheet metal defining a cooking chamber for cooking foodstuff, and a central opening for placing foodstuff into the cooking chamber. Such cavity according to the present invention is characterized in that the outer surface of at least one of the cavity walls comprises a coating, wherein the coating comprises at least one material with a low emissivity. Preferably, said material with a low emissivity has a lower emissivity than oxidized steel.

As will be discussed in more detail below, in the prior art oven cavities that are formed of steel and that comprise an inner surface of the cavity that is covered by a layer of fired enamel, the outer surface of the cavity is generally covered by a layer of oxidized steel that is generated during the firing of said enamel. Said outer layer of oxidized steel has the typical black color and the resulting high emissivity of oxidized steel, causing thus major heat losses towards the surrounding during the heating of the outwardly black-coloured, oxidized steel oven cavities of the prior art.

According to the present invention, preferably at least the rear, bottom, top, left and right side wall of the heatable cavity comprises the coating. However, additionally or alternatively the front wall may comprise the coating.

The present inventors have surprisingly found that with the coating that comprises a material with a low emissivity according to the present invention the emissivity of heatable cavities are preferably formed of sheet metal, particularly of kitchen appliances, e.g. household ovens, may be significantly lowered. Allowing thus an important energy saving during the operation of an oven that comprises a heatable cavity according to the invention.

It will be immediately understood by a person skilled in the art that usually a heatable cavity comprises a plurality of cavity walls, which define a cooking chamber into which foodstuff to by cooked or baked may be placed. For this purpose, the cooking chamber is defined by the cavity walls, usually comprising a left and a right side wall, a bottom wall and an upper wall, a rear wall and a front wall, whereby one of the cavity walls, usually the front wall comprises a central opening for placing the foodstuff into the cooking chamber. The central opening may be closed or opened, respectively, by a door. The person skilled in the art also knows other configurations of such heatable cavity.

In the context of the present invention, the "inner surface" of a cavity wall is the surface directed to the heated or heatable cooking chamber defined by said cavity walls. Accordingly, an "outer surface" of a cavity wall is the surface facing away from said cooking chamber.

The present inventors turn away from the teaching of the prior art, according to which the reflection of heat inwardly, i.e. towards the cooking chamber, is favored, by adding some heat reflecting material to the enamel coating layer of the inner surface of the heatable cavity Whereas the heatable cavity according to the present invention may comprise or may not comprise an inner surface of cavity walls with reflective materials, a coating comprising such reflective material, or the like. Importantly, however, the heatable cavity according to the present invention comprises a coating applied to the outer surfaces of at least one cavity wall that is preferably formed of sheet metal, preferably all cavity walls, which reduces the outwards emissivity of such heatable cavity.

Such coating can be bright colored, e.g. light grey, silver, white or any other light color like powder blue or others. In connection therewith, a person skilled in the art knows that color of a material usually refers to absorption and/or reflection in visible wavelengths.

In an advantageous embodiment of the inventive heatable cavity, the coating that comprises a material with a low emissivity is an adherent coating that is firmly attached to at least part of the outer surface of the heatable cavity, such as for example a lacquer that comprises said material with a low emissivity.

Preferably, the coating comprises a material with a low emissivity that has a lower emissivity than the oxidized steel on the outer surface of the oven cavity to which it is applied, in order to cover said oxidized steel at least in part, thereby effectively reducing the emissivity of the outer surface of the heatable oven cavity. In preferred embodiments of the invention, the reflective material comprises small particles with a low emissivity. Said small particles can preferably be selected from the group comprising aluminum particles, chrome particles, stainless steel particles, zinc particles, tin particles and tin-oxide particles. Preferably, such small particles can have a low emissivity, especially a lower emissivity than oxidized steel, even when they are themselves in an oxidized state.

In an advantageous embodiment of the inventive heatable cavity, the cavity walls comprise oxidized steel. A person skilled in the art knows that the walls of a heatable cavity are usually made of mainly un-oxidized steel. However, the outer surface of the cavity walls usually become oxidized, forming a thin black scale layer of oxidized steel, during high temperature treatment. That happens frequently during firing of enamel on the inner surface of the heatable cavity during its manufacture, especially during firing an inner surface layer of vitreous enamel. It will therefore be understood that heatable cavities that comprise a layer of vitreous enamel on the inner surface frequently comprise a layer of oxidized steel on their outer surface, wherein said outer layer of oxidized steel has an unfavourably high emissivity and therefore contributes importantly to the heat losses during the operation of the corresponding oven. To lower the emissivity of such heatable cavity, particularly of the outer cavity surface, the present invention proposes to apply a low emissivity coating on top of the oxidized steel on the cavity's exterior.

According to the method of manufacturing a heatable cavity of the present invention, which involves an initial step of forming a cavity from sheet metal, a later step of coating the inner surface of the cavity with enamel and of firing the enamel and the cavity during which an outer layer of oxidized steel is formed, in a still later step a coating that comprises a material with a low emissivity is applied onto at least part of said outer layer of oxidized iron that is formed during the firing of the enamel layer on the inner cavity surface. In that way the outer black layer of oxidized steel is coated by the coating of the invention that comprises a material with a low emissivity, thus effectively eliminating the unfavourable high emissivity of the layer of oxidized steel on the outer surface of the cavity that has been formed during the firing of the enamel.

In an advantageous embodiment of the inventive heatable cavity, the cavity, particularly at least one of the cavity walls, can be enameled, preferably the inner surface of at least one of the cavity walls can be enameled. According to the invention, the enamel can be a vitreous enamel that requires firing at typical elevated temperatures, however at which temperatures the steel in the regions of the cavity surfaces that are not protected by enamel will be at least partly converted into a surface layer of oxidized black steel. The coating according to the present invention may be applied also on top of such enameled inner cavity surface and on top of any enamel on the outer cavity surface. For example, if the outside is—intentionally or unintentionally—enameled, e.g. by "sloppy" enameling of the inside, the coating according to the present invention may be applied on top of such enamel. Preferably however, the coating according to the present invention shall be applied on top of said layer of oxidized steel on the outside of the cavity walls.

Advantageously, at least one of the cavity walls may be enameled. Preferably, the heatable cavity is an enameled cavity, whereby all cavity walls are enameled. The low emissivity coating according to the present invention shall be applied preferably on the outer surface of the heatable cavity, i.e. on the outer surface of at least one of the cavity walls after enameling. Particularly, such cavity walls may comprise oxidized steel or, more particularly, an oxidized steel layer, and a coating on said oxidized steel layer, wherein the coating comprises at least one material with a low emissivity.

Preferably, an enameled layer is applied to the heatable cavity before a step of applying the coating with a material with low emissivity of the invention. Accordingly, a coating according to the present invention may be arranged on top of an enameled layer and/or on top of a layer of oxidized steel that has been formed during a step of firing said enamel layer. However, additionally or alternatively, the coating with a material with low emissivity may also be applied to at least part of the outer surface of the heatable cavity during or concomitant with the enameling of the inner surface of the heatable cavity. Particularly, the coating with a material with low emissivity may be combined with an enamel layer for the outer surface of the heatable cavity, by adding reflective particles having relatively low emissivity to a suitable enameling material that can be applied to the outer surface of the heatable cavity. For example, an enamel powder can be applied to the outer surface of at least one cavity wall and a relatively thin layer of said reflective particles is applied on said enamel powder in addition. Additionally, a thin layer of electrically conducting metal-oxide that has how-ever a suitable low emissivity, such as e.g. $SnO_2$, can be applied for example, by spraying. Both layers on the outer surface of the heatable cavity, the enamel and the low emissivity coating, may be burned in one-step. Alternatively, the particles with low emissivity cany be admixed to any suitable enamel frit and may be applied to the outer surface of the heatable cavity using standard enamel techniques.

In an advantageous embodiment of the inventive heatable cavity, the coating that comprises a material with low emissivity further comprises a binder.

Such binder may be selected from silicone based binder and silicone emulsion. Such binder, particularly a silicone based binder or silicon emulsion is advantageous in temperature stability, fast drying, low toxicity, easy application, and/or easy cleaning of equipment. Particularly, the binder may be a silicone based water emulsion paint. Such Silicone based water emulsion paint has the advantages of temperature stability, fast drying, low toxicity, easy application, and easy cleaning of equipment.

In an advantageous embodiment of the inventive heatable cavity the coating that comprises a material with low emissivity further comprises at least one solvent.

Such solvent may be selected from the group comprising xylene and water.

In an advantageous embodiment of the inventive coating that comprises a material with low emissivity, the coating is a spray paintable coating.

Such coating according to the present invention may be spray-painted. Alternatively, such coating may be applied by dipping or roller application.

Applying the coating that comprises a material with low emissivity of the present invention to the heatable cavity of the present invention advantageously can be an take the form of an adherent coating, e.g. such as a lacquer, that allows for a direct contact of the coating to the heatable cavity wall, particularly by avoiding gaps in-between coating and heatable cavity wall. Thereby, the thermal losses from the heated cavity are importantly reduced as compared to the prior art, wherein usually a foil, particularly an aluminum foil, is wrapped around the heatable cavity, i.e. surrounding the heatable cavity, and used to cover the cavity's outer surface. Thereby, gaps and spaces in-between such foil and cavity walls are difficult to avoid in the prior art solution. Such application of a foil, particularly if applied as an IR barrier, has the additional disadvantage of a higher thermal mass that contributes to the energy requirement of heating up the cavity during the oven operation compared to a coating according to the present invention, particularly wherein the coating that comprises a material with low emissivity of the present invention can be a substantially thinner coating than the aluminium foil used in the prior art. Moreover, the coating that comprises a material with low emissivity according to the present invention may be applied such that substantially no gaps with air between the cavity wall and the coating are formed. Whereas such undesired small gaps with air usually may occur between the cavity wall and the aluminium foil of the prior art. When the air is heated up the pressure rises and the hot air is pushed outside. So energy is lost in the prior art if such small gaps are formed.

A coating that comprises a material with low emissivity according to the present invention applied to the heatable cavity and/or household appliance according to the present invention, is also referred to herein as "low emissivity cavity coating" or "low emissivity coating". The coating may be applied, e.g. spray-painted, on the outside of the heatable cavity selectively or the outside of a cavity wall may be entirely coated with the coating. For example, a coating according to the present invention may be applied only to a part of the surface of the cavity wall. In an embodiment of the heatable cavity according to the present invention, the entire outer surface of a cavity wall is coated with the coating. In addition or alternatively, only a part of the outer surface of a cavity wall is coated with the coating.

According to the present invention, the outer surface of at least one of the cavity walls comprises a coating, wherein the coating comprises reflective material with a low emissivity. Additionally, also at least a part of the inner surface of a cavity wall may comprise a coating according to the present invention. For example, a coating according to the present invention may be applied only to a part of the surface of the heatable cavity, e.g. areas near heating elements inside the cavity can be simply coated to reduce heat emission to the outside from the inside heating elements.

Thereby, it is very simple to leave an area of an outside mounted element, e.g. a heating element, free, permitting the infra-red reflection from such element, particularly such heating element, into the heatable cavity. Depending on the components of the inventive coating, e.g. comprising a high temperature silicone emulsion, it may withstand relatively high temperatures of up to about 540° C. after curing. Curing may occur at room temperature or first heat up of the heatable cavity or appliance. Advantageously, no additional energy may be necessary to burn in the coating.

Heatable Cavity

The term "emissivity" as used herein, preferably refers to the effectiveness of a surface and/or of its material in emitting energy as thermal radiation. Thermal radiation preferably refers to light, more preferably to infrared radiation. Quantitatively, "emissivity", as used herein may be calculated, preferably, as the ratio of the thermal radiation from a surface to the radiation from an ideal black surface at the same temperature. The ratio varies from 0.0 to 1.0. At room temperature of 20° C., i.e. 293,15K, the surface of a (ideal) black object emits thermal radiation at the rate of 418.77 watts per square meter ($W/m^2$); real objects with emissivities less than 1.0 emit radiation at correspondingly lower rates.

As used herein, "emissivity" preferably additionally or alternatively refers to the emissivity of the outer surface of the heatable cavity according to the present invention and/or to the outer surface of at least one of the cavity walls of the heatable cavity according to the present invention.

The term "low emissivity" as used herein, preferably refers to an emissivity of less than 0.9, preferably of less than 0.85, more preferably of less than 0.75, still more preferably of less than 0.55, most preferably of less than 0.25.

In particularly preferred embodiment, the coating has an emissivity of about 0.2 to about 0.3, preferably of about 0.2 to 0.25.

In an advantageous embodiment of the inventive heatable cavity, the coating, particularly the reflective material thereof, has a relatively low emissivity of less than 0.9, preferably of less than 0.85, more preferably of less than 0.75, still more preferably of less than 0.55, most preferably of less than 0.25. In particularly preferred embodiment, the coating, particularly the reflective material thereof, has an emissivity of about 0.2 to about 0.3, preferably of about 0.2 to 0.25.

A person skilled in the art will immediately be able to determine whether a coating, particularly the reflective particles thereof, has a low emissivity. Particularly, the person skilled in the art knows methods to determine the emissivity of a coating, particularly of reflective particles thereof. For example, the person skilled in the art knows the methods applied and described in accordance with the American Society for Testing and Materials (ATSM) and the Reflective Insulation Manufacturer's Association (RIMA), which have established an industry standard for evaluating paints claiming to have insulating characteristics. The energy conserving property has been defined as thermal emittance (the ability of a surface to release radiant energy that it has absorbed). The coatings qualified as Interior Radiation Control Coatings must show a thermal emittance of 0.25 or less, which also reflects the particularly preferred range according to the present invention. Additionally, a person skilled in the art knows that for non-transparent materials the optical reflectiveness of the surface is connected to the emissivity. Therefore, when a material has a high reflectiveness and keeps this over time (oxidation) it is usable for the purpose of the present invention. The emissivity as used herein preferably is determined and measured by comparing the temperature of a heated material that was measured with a contact thermocouple with the measured temperature measured with an infrared thermometer (pyrometer) set to an emissivity of 1.

In an advantageous embodiment of the inventive heatable cavity, the particles are flake shaped or "silver dollar" shape particles.

Such flake or "silver dollar" shaped particles, e.g. aluminum particles, advantageously allow achieving an arrangement of particles, which is advantageous in low emissivity. In an embodiment, the orientation of the flake or "silver dollar" shaped particles is substantially parallel to the substrate, which allows achieving a more optimal reflection. A person skilled in the art will immediately acknowledge that the orientation of the flake or "silver dollar" shaped particles depends on the application mechanism and/or shrinking of coating film when the solvent is lost. In the coating according to the present invention relatively thin flake or "silver dollar" shaped particles, e.g. of 50 nm thickness or less, are preferred. This advantageously allows that the orientation of the flake or "silver dollar" shaped particles parallel to the substrate is better.

In an advantageous embodiment of the inventive heatable cavity, the coating is a lacquer. In an embodiment, the lacquer comprises a binder, particles and a solvent. A lacquer comprising stabilized aluminum pigments as particles is preferred. Stabilization of aluminum pigments advantageously allows inhibiting oxidation, particularly in a water based formulation of a lacquer. As a result, the pigments can be stabilized for better storage of the lacquer.

Particularly, the coating according to the present invention applies on a cavity wall of a heatable cavity according to the present invention could be applied as a lacquer, for example, with the herein also described flake or "silver dollar" shaped particles.

In an embodiment the coating according to the present invention, particularly if the coating is a lacquer, the coating may be needed to be stirred-up before applying on the cavity wall to be coated. Depending on particle size and/or type comprising leafing, where particles float to top, or non-leafing, where particles are evenly distributed, the particles may advantageously be redistributed before application to get an even amount of particles during the application.

In an advantageous embodiment of the inventive heatable cavity the thickness of said coating is lower compared to an aluminum foil usually applied on the outside of the heatable cavity.

Thereby, a person skilled in the art will immediately acknowledge that an optimal thickness of the coating depends on the parameters of the desired particles, particularly on the particle orientation, size, thickness, type, or the like. Advantageously, a relatively low layer thickness of the inventive coating is sufficient.

In connection therewith, the present inventors have found that such relatively low layer thickness of the inventive coating, particularly, if based on the amount of lacquer that was used to paint half the heatable cavity, preferably is a thickness of less than 30 μm, preferably less than 20 μm. Particularly, the thickness may be of about 15 μm to about 30 μm, about 10 μm to about 30 μm, about 5 μm to about 30 μm, about 0.5 μm to about 30 μm, or about 0 μm to about 30 μm. Preferably, the thickness is about 15 μm to about 20 μm, about 10 μm to about 20 μm, about 5 μm to about 20 μm, about 0.5 μm to about 20 μm, or about 0 μm to about 20 μm, A person skilled in the art will immediately recognize that a coating of about 20 μm results in a calculated additional thermal mass of about 30 g for half of the heatable cavity referring to a US type cavity or about 40 g for a full, referring to a European type heatable cavity.

According to the teaching of the present application, the coating according to the present invention may comprise various components. Particularly, the coating according to the present invention may be provided with various physical or chemical properties.

In an embodiment, the coating according to the present invention is provided in liquid physical form.

In an embodiment, the coating according to the present invention is provided in silver color.

The above described problems are also advantageously solved by a kitchen appliance, particularly an oven.

Such a kitchen appliance, particularly an oven, comprises:

a heatable cavity preferably formed of sheet metal, heating elements for heating said cavity, and a door for closing the y, particularly the central opening of the cavity, wherein the heatable cavity is a heatable cavity according to the present invention.

In an embodiment of the kitchen appliance according to the present invention and/or the heatable cavity according to the present invention the kitchen appliance is a cooking and/or baking device for cooking and/or baking of foodstuff. Such kitchen appliance, preferably a cooking and/or baking device, may particularly be a kitchen appliance selected from the group comprising an oven, baking oven, microwave, steam-oven, and steam-cooker.

The above described problems are also advantageously solved by a method of manufacturing a heatable cavity for a kitchen appliance, particularly an oven, as herein described, and to a kitchen appliance, particularly an oven, obtained by said method.

Such method of manufacturing a heatable cavity for a kitchen appliance, particularly an oven, comprises at least a) an initial step of forming a cavity of a predetermined size and shape from sheet metal, in particular by joining corresponding sheet metal edges by welding, b) a later step of coating at least part of the inner surface of the cavity obtained in step a) with an enamel material and of subsequently firing the cavity and the enamel, wherein the steel of at least a part of the outer surface of the cavity that is not covered by enamel receives an outer layer of oxidized steel, characterized by c) a still later step of applying a coating (10) onto at least part of said outer layer of oxidized steel formed in step b) on the outer surface of the cavity walls, wherein said coating (10) comprises a material with a low emissivity, preferably wherein the material has a lower emissivity than oxidized steel, still preferably wherein said the coating (10) is an adherent coating (10), such as a lacquer, that comprises small particles (4) with a low emissivity, still preferably wherein said small particles have a lower emissivity than oxidized steel, still preferably wherein said small particles (4) are selected from the group comprising aluminum particles, stainless steel particles and tin-oxide particles.

In an embodiment of the method of manufacturing a heatable cavity for a kitchen appliance according to the present invention, the method comprises a step of enameling the cavity, preferably the cavity walls, in particular an inner and/or an outer surface of the cavity wall, prefarably an outer surface of at least one cavity wall, preferably wherein said step of enameling is carried out before a step of applying said coating with a material with a low emissivity. However, additionally or alternatively, said coating may also be applied during or concomitant with the enameling of the heatable cavity. Particularly, the coating may be combined with an enamel layer for the outer surface of the heatable cavity, using the reflective particles having relatively low emissivity, especially as compared to the emissivity of oxidized steel.

All described embodiments of the invention have the advantage, that a heatable cavity with the low-emissivity coating of the present invention and/or a household appliance comprising such heatable cavity, the coating allows for a significantly lower emissivity of the cavity surface, particularly the outer cavity surface, which emits less energy in the direction of the insulation, which results in a lower energy consumption of the appliances during heating.

Compared to the usual application of an aluminum foil on the outside of the heatable cavity, the coating applied to the cavity of the present invention may be applied without gaps, which form between surface and foil/coating. The inventive coating applied to the heatable cavity according to the present invention allows for a relative small thickness of the coating, which preferably does not add significantly to the thermal mass of the appliance. Advantageously, the coating applied to the heatable cavity of the present invention allows for relatively low outside temperature of a household appliance according to the present invention, due to the reduced heat radiation that is absorbed by the coating. Additionally, a heatable cavity according to the present invention may comprise an insulation layer, e.g. a layer of glass or stone wool. The coating applied to the heatable cavity of the present invention allows for a lower energy consumption during heating and/or a lower housing temperature of an appliance according to the present invention. The reduction of the energy consumption, which is advantageously achieved by the inventive coating, thereby depends on the type of kitchen appliance. However, if the reduction of the energy consumption is assessed with the same test procedure, the energy consumption of the kitchen appliance according to the present invention is reduced compared to the same type of kitchen appliance without the coating according to the present invention. Advantageously, the coating applied to the heatable cavity of the present invention thereby does not significantly add an extra thermal mass.

The present invention will be described in further detail with reference to the drawings from which further features, embodiments and advantages may be taken, and in which.

Figure 1:
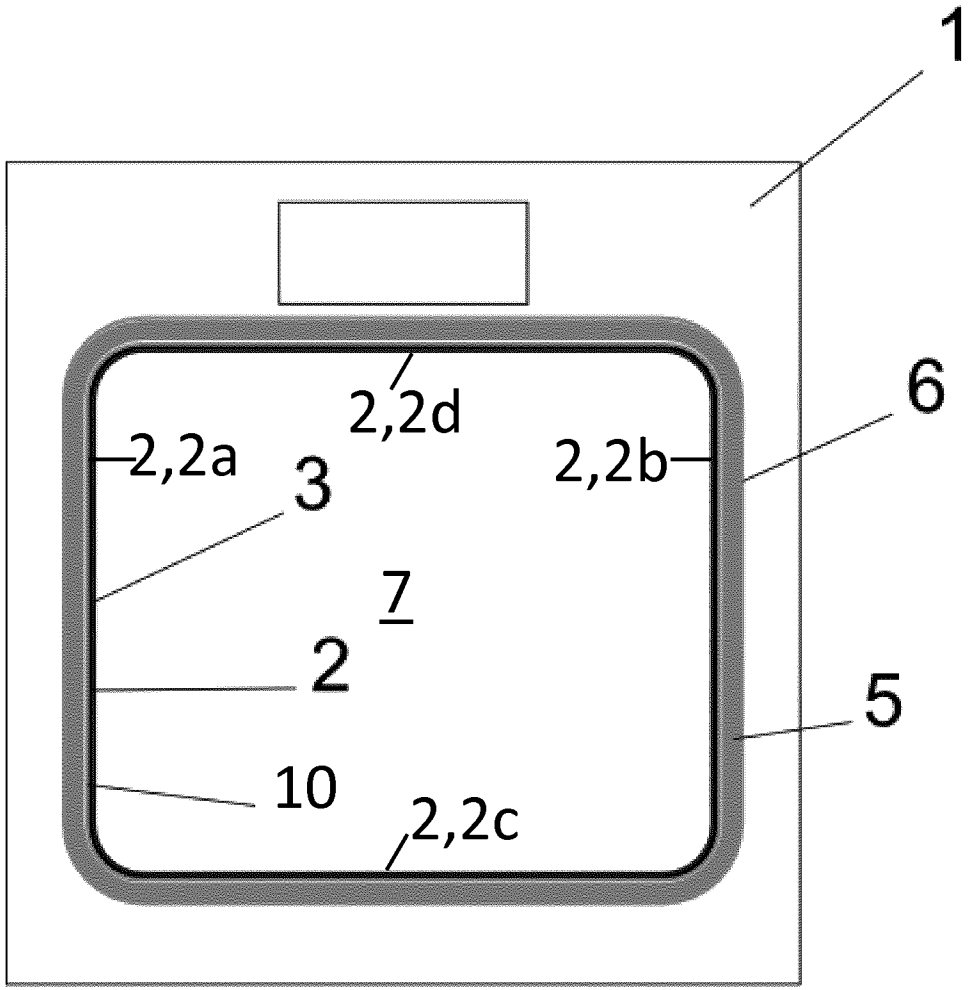
FIG. 1 shows a schematical view of a kitchen appliance according to a first inventive embodiment.

FIG. 1 shows a schematical front view of a kitchen appliance 1 according to the present invention. Such kitchen appliance 1, particularly an oven, comprises a heatable cavity 2 according to the present invention. Such heatable cavity 2 comprises cavity walls, for exampled made of steel, which define a cooking chamber 7 into which foodstuff to by cooked or baked may be placed. For this purpose, the cooking chamber 7 is defined by the cavity walls, usually comprising a left and a right side wall, 2*a* and 2*b*, respectively, a bottom wall 2*c* and an upper wall 2*d*, a rear wall and a front wall (the two latter not shown in FIG. 1) One of the cavity walls, usually the front wall comprises a central opening for placing the foodstuff into the cooking chamber 7. The central opening may be closed or opened by a door, respectively. A kitchen appliance 1, particularly an oven, usually further comprises also not shown heating elements for at least one of heating the cooking chamber 7 and heating food to be cooked. Such heating elements may be disposed at a cavity wall.

Such heatable cavity 2 according to the present invention is characterized in that the outer surface of at least one ty wall, preferably at least the upper, lower, left and right cavity wall, more preferably all cavity walls, comprises a coating 10, wherein the coating 10 comprises reflective material with a low emissivity. In FIG. 1 for better understanding of the invention and, particularly the arrangement of the coating 10 according to the present invention a schematical front view of a kitchen appliance 1 according to the present invention is shown. For this purpose only the upper 2*d*, bottom 2*c*, left 2*a* and right 2*b* cavity wall is shown. The "inner surface" of the cavity walls 2*a*, 2*b*, 2*c*, and 2*d*, respectively, is the surface directed to the heated or heatable cooking chamber 7 defined by the cavity walls, and the "outer surface" of said cavity walls is the surface facing away from said cooking chamber 7. The present inventors have surprisingly found that with a coating 10 according to the present invention the emissivity of the heatable cavity 2 may be significantly lowered. The coating 10, which comprises particles 4 having a low emissivity, the coating 10 in FIG. 1 being a low emissivity lacquer according to the present invention, is applied on the outer surface of the cavity walls. A relatively low layer thickness of such coating 10 is sufficient to significantly reduce emissivity of the outer cavity surface. As may be immediately taken from FIG. 1 the inner surface of the cavity walls according to the shown embodiment is enameled, i.e. comprises an enameled layer 3. On top of the coating 10 an insulation material is arranged as an insulation layer 5, e.g. comprising stone or glass wool. Additionally, arranged above the insulation layer 5 a foil layer 6, here an aluminum foil layer 6, is arranged.

Figure 2:
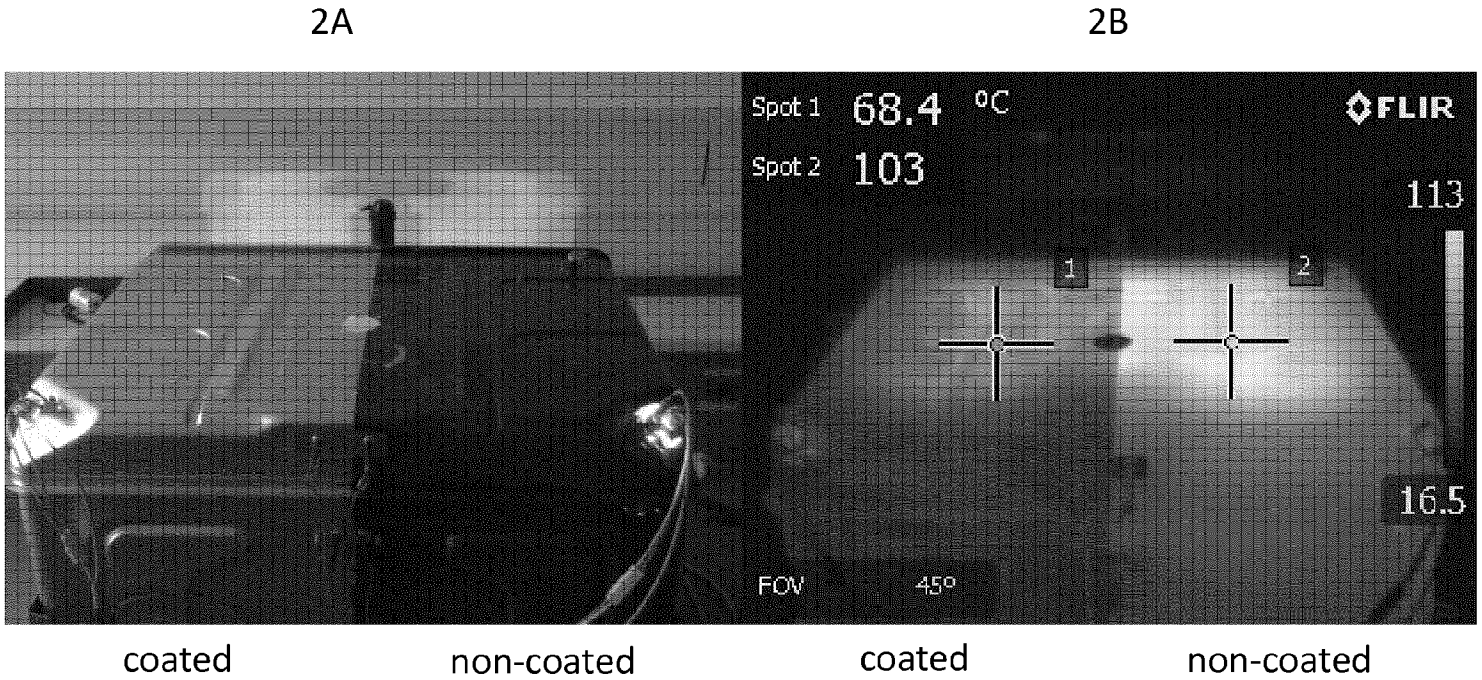
FIG. 2 shows a thermal image of a heatable cavity that was coated on the left half with a low emissivity according to the present invention.

FIG. 2 shows a thermal image of a heatable cavity 2 of a kitchen appliance 1 according to the present invention, particularly without the oven housing, which was coated half, on the left side with a low emissivity coating 10, specifically a lacquer, according to the present invention. The cavity 2 then was heated up uniformly. As may be immediately taken from FIG. 2 the emissivity of the left side, with the coating 10 is significantly lower compared to the emissivity of the non-coated right side of the cavity 2. This advantage effect is immediately obvious, since the coated left side appears cooler to the thermal camera than the non-coated right side of the cavity 2.

A coating as used for the heatable cavity and/or household appliance according to the present invention, also referred to herein as "low emissivity cavity coating" or "low emissivity coating" is based on a reflective metal, preferably aluminum flakes, more preferably "silver-dollar"-shaped flakes, and, optionally a binder and a solvent, particularly if the coating is a lacquer. The coating 10 may be spray painted on the outside of the heatable cavity 2 selectively. For example, a coating 10 according to the present invention may be applied only to a part of the surface of the heatable cavity 2, e.g. areas near heating elements inside the cavity can be simply coated to reduce heat emission to the outside from the inside heating elements. Thereby, it is very simple to leave an area of an outside mounted element, e.g. a heating element, free, permitting the infrared reflection from such element, particularly such heating element, into the cavity. Depending on the components of the inventive coating, e.g. comprising a high temperature silicone emulsion, it may withstand relatively high temperatures of up to about 540° C. after curing. Curing may occur at room temperature or first heat up of the heatable cavity or appliance. Advantageously, no additional energy may be necessary to burn in the coating.

The coating 10, which is applied to the outer surface of the heatable cavity 2 according to the present invention and/or according to the method of the present invention comprises small particles 4 having a low emissivity, e.g. aluminum, stainless steel, or tin-oxide particles and may further comprise a binder. Particularly, a coating 10 in the form of a lacquer may comprise binder, particles and/or pigments, and solvent. According to one particular embodiment of the present invention the coating 10 is based on aluminum particles to achieve the low emissivity, a silicone based binder to hold the aluminum particles and xylene as a solvent. According to another particular embodiment of the present invention, the coating is based on aluminum particles bound by a silicone emulsion that can be diluted with water as a solvent. Depending on the particular composition, the coating may dry at room temperature or has to be cured. The coating 10 is preferably spray paintable onto the outside of the cavity 2 and/or cavity walls or may, alternatively, be applied by dipping, or roller application.

Preferably, such coating is of a relatively bright color, e.g. light grey, silver, white or any other light color like powder blue or others. Such coating may allow to reach values between 0.2 and 0.3 or even lower. The particles of such coating, e.g. aluminum particles, preferably are flake or "silver dollar" shaped. Aluminum particles of "silver dollar" shape are preferred, as such "silver dollar" shape is particularly advantageous resulting in relatively good reflectivity, by a smooth surface of the particles.

The coating applied to the heatable cavity shown in FIG. 2 may particularly may be based on acrylic or vinyl polymers in an aqueous solution. Such coating may be applied in liquid physical form. Here a silver colored coating with an ethereal alcohol odor is applied. However, a person skilled in the art will know other color and odor combinations.

Figure 3:
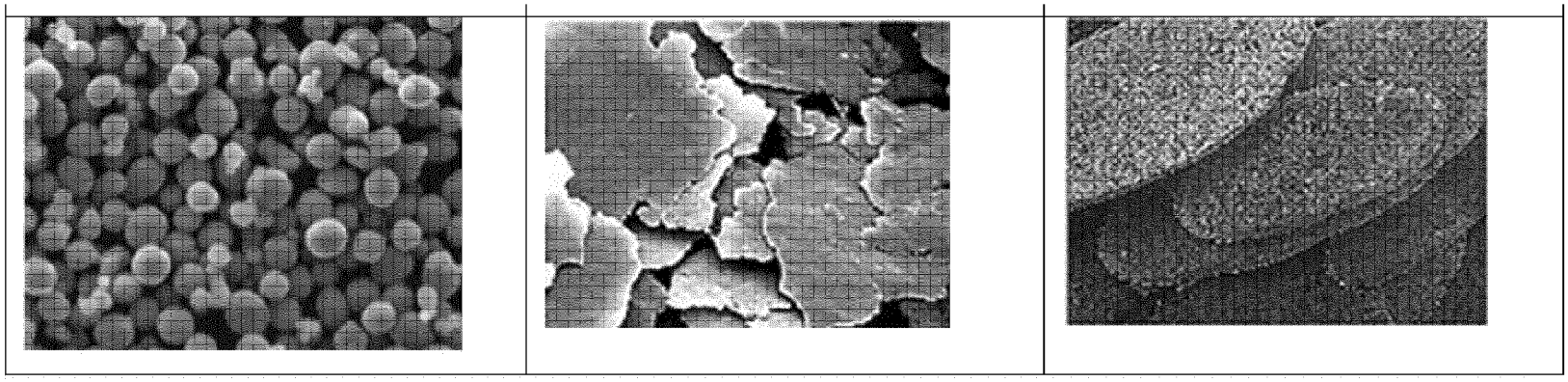
FIG. 3 shows different shapes of aluminum particles.

For better understanding in FIG. 3 three examples of different shapes of aluminum particles are shown. On the left in FIG. 3A standard aluminum pigment is shown. In the middle FIG. 3B aluminum flakes are shown, and on the right, "silver-dollar" shaped aluminum flakes are shown.

With the coating 10 according to the present invention—compared to aluminum foil—no gaps can form between surface and coating. The lower emissivity of the cavity surface with such coating 10 emits less energy in the direction of an insulation 5, e.g. a glass or stone wool layer, usually applied around the heatable cavity 2, which results in a lower energy consumption of the appliances during heating. The coating works with a lower layer thickness compared to the usually applied foil. Advantageously the coating 10 according to the present invention does not add significantly to the thermal mass of the appliance 1. The outside temperature of an appliance 1 according to the present invention is lower—as may be immediately seen in FIG. 2, due to the reduced heat radiation that is absorbed.

The features of the present invention disclosed in the specification, the claims, and/or the figures may both separately and in any combination thereof be material for realizing the invention in various forms thereof.

LIST OF REFERENCE NUMERALS

1 kitchen appliance
2 heatable cavity
2*a*, 2*b*, 2*c*, 2*d* cavity walls
3 enamel
4 particles
5 insulation
6 foil
7 cooking chamber
10 coating comprising material with low emissivity

The invention claimed is:

1. A heatable cavity for a kitchen appliance, wherein the heatable cavity comprises a plurality of cavity walls defining a cooking chamber for cooking foodstuff, and a central opening for placing foodstuff into the cooking chamber, wherein an outer surface of at least one of the cavity walls comprises a coating that comprises a material with low emissivity lower than oxidized steel, wherein at least part of said outer surface of the at least one of the cavity walls comprises a layer that comprises oxidized steel, and is at least partially covered by said coating.

2. The heatable cavity according to claim 1, wherein said coating is an adherent coating that comprises small particles having a low emissivity.

3. The heatable cavity according to claim 1, wherein at least one of the cavity walls is enameled.

4. The heatable cavity according to claim 1, wherein said coating that comprises a material with low emissivity further comprises a binder.

5. The heatable cavity according to claim 4, wherein the binder is selected from silicone based binder and silicone emulsion.

6. The heatable cavity according to claim 1, wherein said coating that comprises a material with low emissivity further comprises a solvent.

7. The heatable cavity according to claim 6, wherein the solvent is selected from the group consisting of xylene and water.

8. The heatable cavity according to claim 1, wherein said coating that comprises a material with low emissivity is a spray paintable coating.

9. The heatable cavity according to claim 1, wherein said coating that comprises a material with low emissivity has an emissivity of about 0.2 to about 0.3.

10. The heatable cavity according to claim 2, wherein said small particles having low emissivity are flake shaped particles.

11. The heatable cavity according to claim 1, wherein said coating that comprises a material with low emissivity is a laquer.

12. The heatable cavity according to claim 1, wherein the thickness of said coating that comprises a material with low emissivity is lower compared to an aluminum foil usually applied on the outside of a heatable cavity.

13. A method of manufacturing a heatable cavity for a kitchen appliance, comprising:

a) an initial step of forming a cavity of a predetermined size and shape from sheet metal, b) a later step of coating at least part of an inner surface of the cavity obtained in step a) with an enamel material and of subsequently firing the cavity and the enamel, wherein at least a part of an outer surface of the cavity that is not covered by enamel receives an outer layer of oxidized steel, c) a still later step of applying a coating onto at least part of said outer layer of oxidized steel formed in step b) on the outer surface of the cavity, wherein said coating comprises a material with a low emissivity lower than oxidized steel and is a lacquer that comprises small particles having low emissivity, said small particles being selected from the group consisting of aluminum particles, stainless steel particles and tin-oxide particles.

14. A kitchen appliance, comprising the heatable cavity according to claim 1, heating elements for heating said cavity, and a door for closing the cavity.

15. The heatable cavity according to claim 2, wherein said small particles are selected from the group consisting of aluminum particles, stainless steel particles and tin-oxide particles.

16. The heatable cavity according to claim 3, wherein at least part of the inner surface of the heatable cavity is enamelled.

17. A method of making a kitchen appliance comprising a metal cavity wall that at least partially defines a cooking chamber, an enamel coating on an inner surface of said cavity wall, an outer surface of said cavity wall being oxidized, a low-emissivity, reflective and adherent coating applied directly to said oxidized outer surface leaving substantially no gaps between said reflective coating and said oxidized outer surface where said coating has been applied, said reflective coating having a thickness less than 20 μm and an emissivity less than 0.25 and comprising metal flakes and a binder, said metal flakes having a thickness of 50 nm or less and being arranged within said coating as to be substantially parallel to said oxidized outer surface, said metal flakes being selected from among aluminum, chrome, stainless steel, zinc, tin and tin oxide, said coating being effective to withstand a temperature of about 540° C., the method comprising applying an enamel coating onto said inner surface of said cavity wall and firing said enamel coating, said outer surface of said cavity wall becoming oxidized as a result of said firing, applying a liquid lacquer directly onto said oxidized outer surface and curing said lacquer to form said low-emissivity, reflective and adherent coating on said oxidized outer surface, said lacquer comprising said metal flakes, said binder and a solvent, said binder being silicone-based and said solvent being selected from among water and xylene.

* * * * *